US008443973B1

(12) United States Patent
Hsu

(10) Patent No.: US 8,443,973 B1
(45) Date of Patent: May 21, 2013

(54) RECEIVING DEVICE FOR TOOL BITS

(76) Inventor: Shao-Hsien Hsu, Taichung (TW)

( * ) Notice: Subject to any disclaimer, the term of this patent is extended or adjusted under 35 U.S.C. 154(b) by 0 days.

(21) Appl. No.: 13/346,673

(22) Filed: Jan. 9, 2012

(30) Foreign Application Priority Data

Dec. 9, 2011 (TW) ..... 100145580 A

(51) Int. Cl.
*B65D 85/28* (2006.01)

(52) U.S. Cl.
USPC ..... 206/374; 206/373; 206/372; 206/376; 206/379; 206/378; 81/177.4; 81/490; 211/70.6; 7/165

(58) Field of Classification Search
USPC ..... 206/374, 378, 373, 376, 379, 234, 206/349, 562–565, 372; D8/85; 211/70.6; 7/165; 81/177.4, 490
IPC ..... B65D 85/28
See application file for complete search history.

(56) References Cited

U.S. PATENT DOCUMENTS

| | | | | |
|---|---|---|---|---|
| 3,187,902 | A * | 6/1965 | Nelson | 211/70.6 |
| 5,704,260 | A * | 1/1998 | Huang | 81/177.4 |
| 6,431,034 | B1 * | 8/2002 | Chen | 81/177.4 |
| 7,434,688 | B2 * | 10/2008 | Hu | 206/377 |
| 8,328,009 | B2 * | 12/2012 | Stahl | 206/139 |
| 2008/0083634 | A1 * | 4/2008 | Parker | 206/373 |

* cited by examiner

*Primary Examiner* — Andrew Perreault
*Assistant Examiner* — James M Van Buskirk

(57) ABSTRACT

A receiving device for tool bits includes a receiving body, at least one receiving space defined on one end of the receiving body, each receiving space having a plurality of first protrusions adequately located therein, each of the receiving space having a plurality of position spaces separated by the first protrusions, the position space having two pairs of fourth protrusions abutting against the periphery of the tool bit so that the tool bit is positioned at the position space and would not drop down from the position space.

3 Claims, 7 Drawing Sheets

RECEIVING DEVICE FOR TOOL BITS

BACKGROUND OF THE INVENTION

1. Field of the Invention

The present invention relates to a receiving device, and more particularly to a receiving device for tool bits.

2. Description of Related Art

A hand tool with replaceable tool bits includes a connecting shaft and a plurality of tool bits. The connecting shaft has a retaining hole opened at one end thereof. A positioning bead is extruded on the inner wall of the retaining hole of the connecting shaft. The tool bit has a notch corresponding to the positioning bead and defined on the outer periphery thereof. Under this arrangement, when a user wants to assemble the tool bit to the connecting shaft, the user inserts one end of the tool bit into the retaining hole and the positioning bead is engaged with the notch of the tool bit at the retaining hole, so that the tool bit is assembled to the connecting shaft; when the user wants to remove the tool bit from the connecting shaft, the user holds the connecting shaft and pulls out the tool bit from the retaining hole. However, the hand tool with replaceable tool bits fails to design a receiving device to stably receive the tool bits. For example, the tool bits received in the conventional receiving device often drops from the receiving holes and the tool bits are easy to drop to the ground when the conventional receiving device is opened.

The present invention has arisen to mitigate and/or obviate the disadvantages of the conventional. Further benefits and advantages of the present invention will become apparent after a careful reading of the detailed description with appropriate reference to the accompanying drawings.

SUMMARY OF THE INVENTION

The main objective of the present invention is to provide an improved receiving device.

To achieve the objective, a receiving device for tool bits comprises a receiving body, at least one receiving space defined on one end of the receiving body and located between two lateral walls which are respectively formed at two laterals of the receiving body, the two receiving spaces separated by a partition which is located in the middle of the two receiving spaces, each receiving space having a plurality of first protrusions extruded from the partition, the first protrusions adequately located at the receiving space, each of the receiving space having a plurality of position spaces defined by the first protrusions and the partition, the position space having two pairs of fourth protrusions, one pair of fourth protrusions extruded from the partition toward the lateral wall and another pair of fourth protrusions extruded from the lateral wall toward the partition, the fourth protrusions abutting against the periphery of the tool bit so that the tool bit is positioned at the position space. Wherein, a second protrusion is extruded from one end of the first protrusion toward the position space; the second protrusion is used to abut against the periphery of the tool bit; the first protrusions of one receiving space are extruded from one side of the partition toward one direction and the first protrusions of another adjacent receiving space are extruded from another side of the partition toward another direction; the first protrusions of one receiving space are extruded from the lateral wall toward one direction and the first protrusions of another adjacent receiving space are extruded from the partition toward the same direction; the position space has a support piece extruded from the bottom of the lateral wall toward the partition; the support piece supports the bottom of the tool bit which is positioned at the position space; a cover is connected to the receiving body; the receiving space of the receiving body is covered by the cover; the receiving body has a driving shaft extended from another end thereof; a third protrusion is extruded from another end of the first protrusion toward the position space for strengthening the foundation of the first protrusion; one pair of fourth protrusions extruded from the partition is symmetrical to another pair of fourth protrusions extruded from the lateral wall so that the two pairs of fourth protrusions respectively abut against the two opposite peripheries of the tool bit.

Therefore, the first protrusion and the fourth protrusions of the position space are arranged for positioning the tool bit firmly so that the tool bit would not drop down from the position space.

Further benefits and advantages of the present invention will become apparent after a careful reading of the detailed description with appropriate reference to the accompanying drawings.

DETAILED DESCRIPTION OF THE INVENTION

Figure 1:
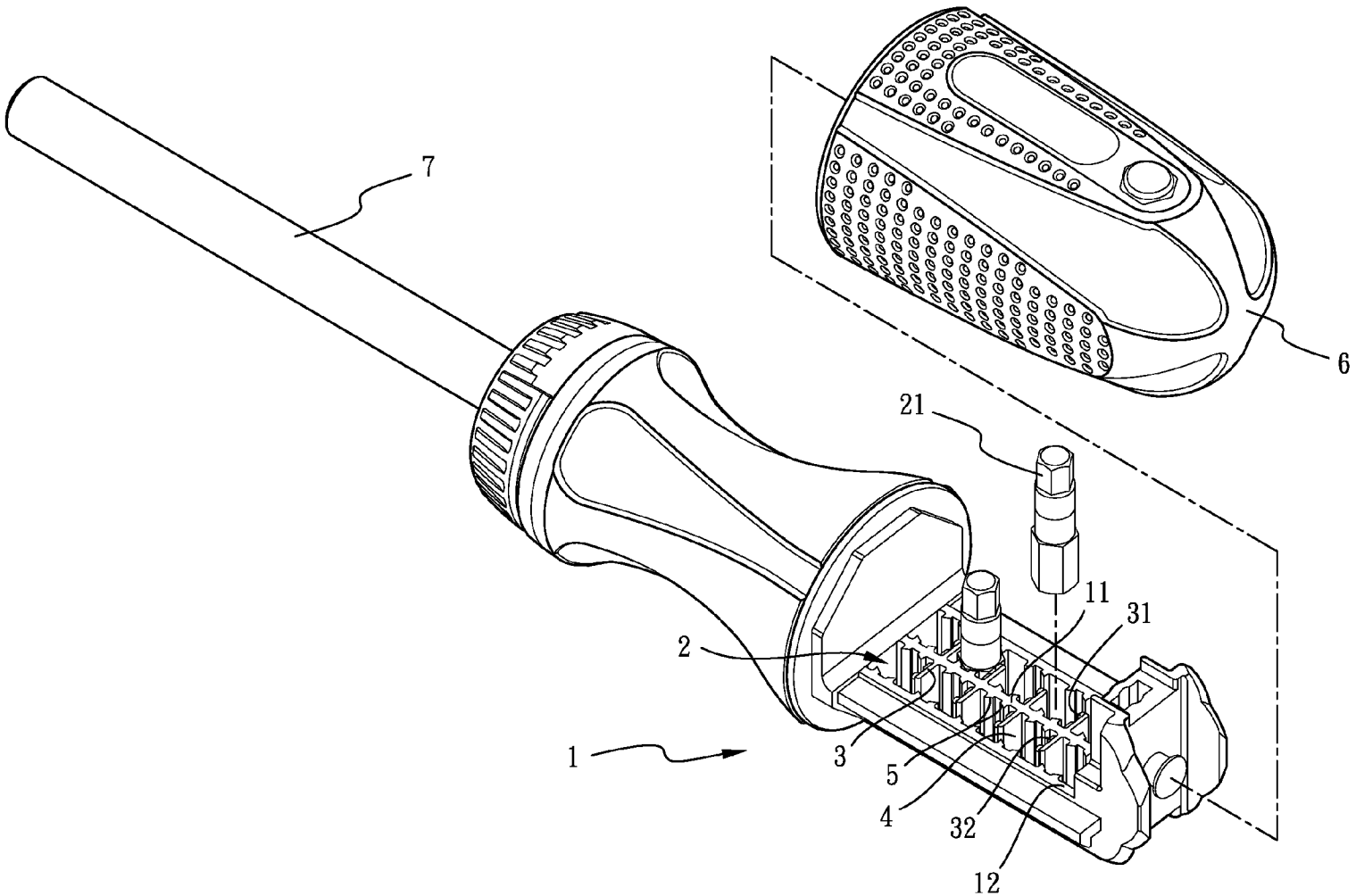
FIG. 1 is an exploded view of a receiving device for tool bits of the present invention.
Figure 2:
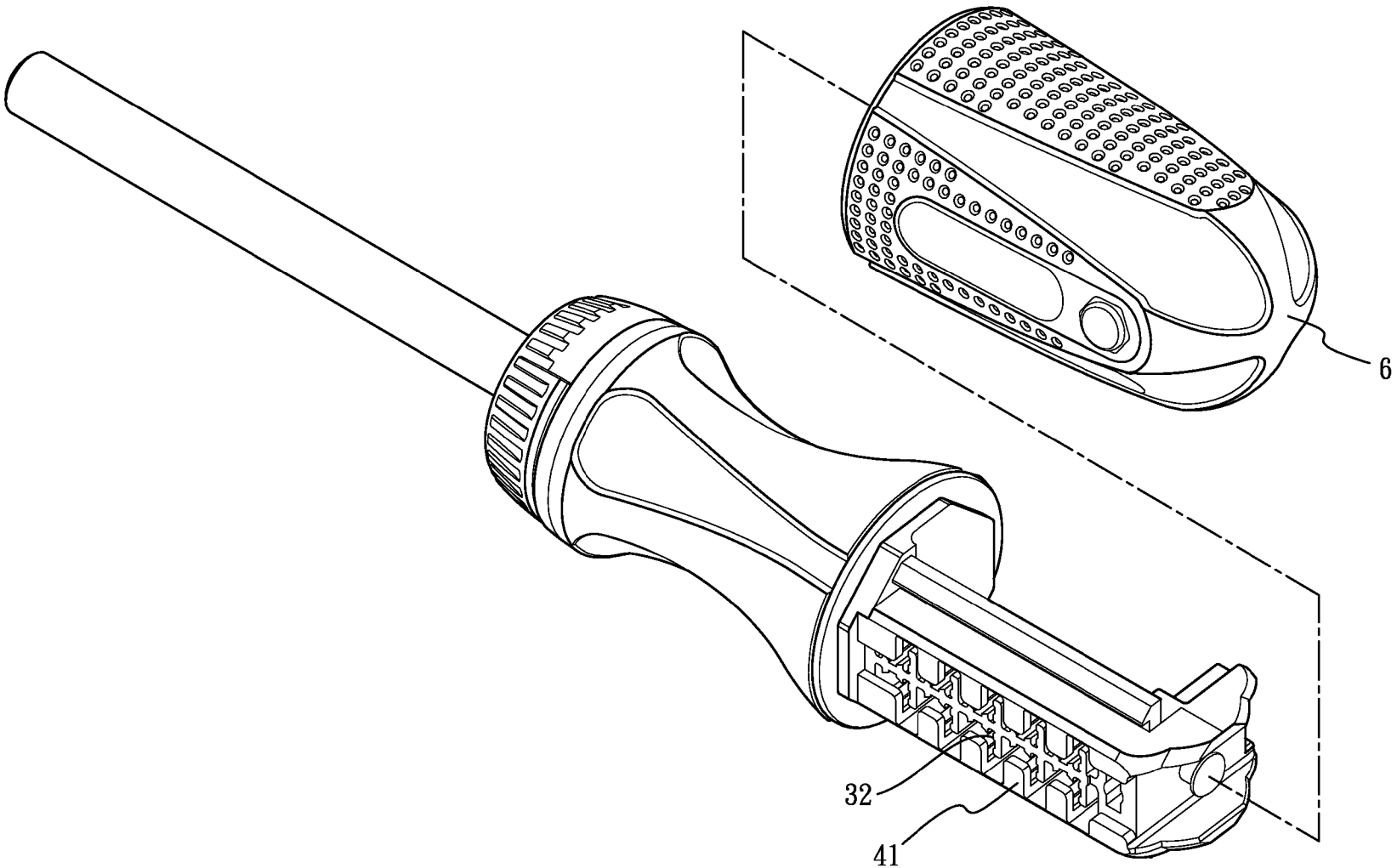
FIG. 2 is another exploded view of the receiving device for tool bits from another viewpoint.
Figure 3:
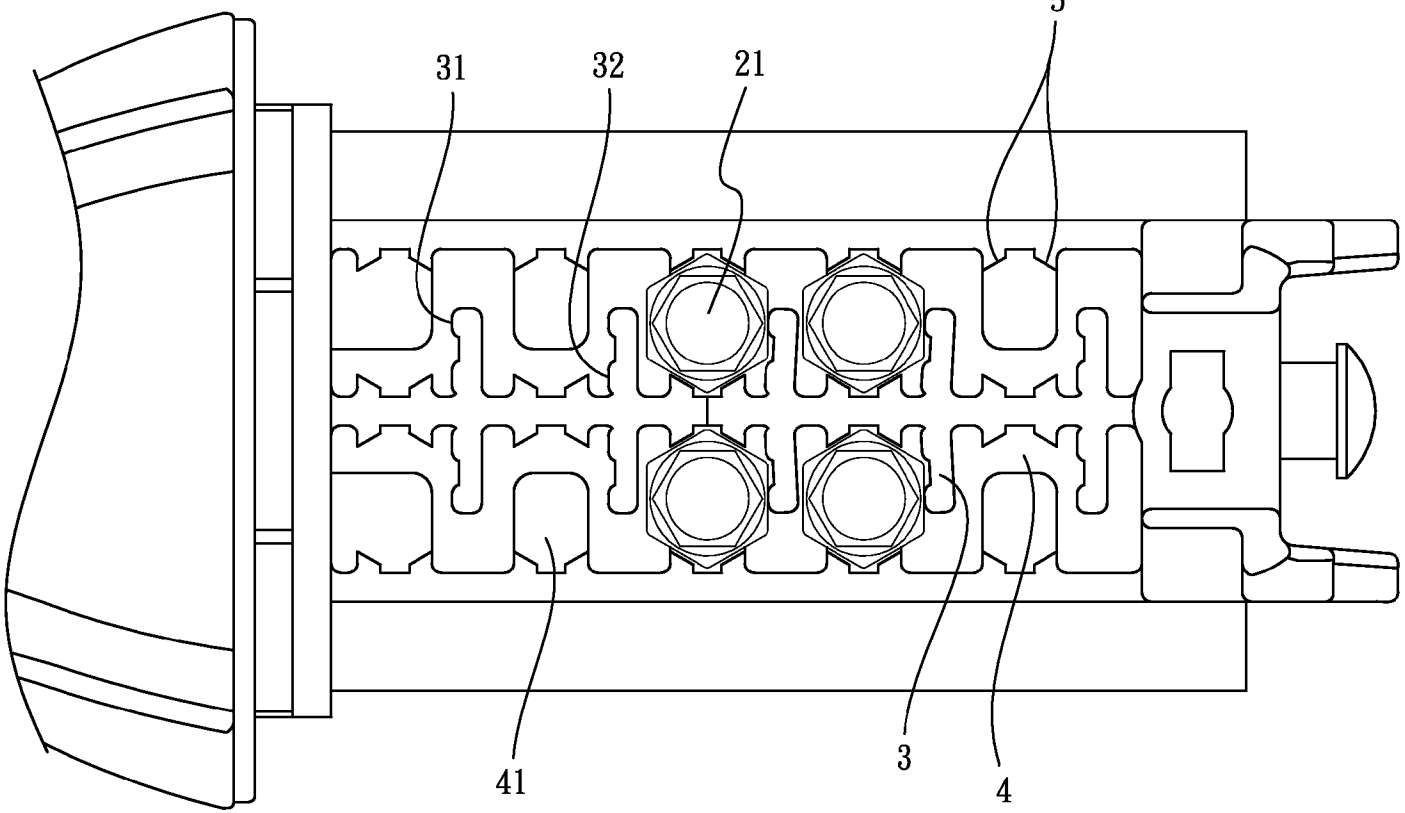
FIG. 3 is a partially enlarged view of the receiving device for tool bits.

Referring to FIGS. 1-3, a screwdriver comprises a driving shaft 7, at least one tool bits 21, and a handle having a cuddy portion or receiving body 1. A storage room 2 is defined in the receiving body 1 and is located between two side walls 12 of the receiving body 1. The storage room 2 is divided by a longitudinal partition 11 which is located in the middle of the storage room 2. Inside the storage room 2 are a plurality of elastic partitioning arms or first protrusions 3 extruded from the partition 11. The first protrusions 3 are adequately located at the storage room 2. In this embodiment, the storage room 2 has ten compartments or position spaces 4 defined by five first protrusions 3 and the partition 11. The position space 4 is used to position a tool bit 21 which has a drive end and a rear end with a hexagonal cross section, as best seen in FIG. 1. A knob or second protrusion 31 is extruded from one end of the first protrusion 3 toward the position space 4. The second protrusion 31 is provided for abutting against the periphery of the tool bit 21. As a result of an elastic restoring force of the first protrusion 3, the tool bit 21 is securely retained in position with the second protrusion 31 bearing against a facet of the hexagonal rear end of the tool bit 21, as shown in FIG. 3. A third protrusion 32 is extruded from another end of the first protrusion 3 toward the position space 4. The third protrusion 32 is provided for strengthening the foundation of the first protrusion 3. The position space 4 has a support piece 41 extruded from the bottom of the side wall 12 toward the partition 11. The support piece 41 supports the bottom of the tool bit 21 which is positioned by the position space 4. The position space 4 has two pairs of retaining ribs or fourth protrusions 5. One pair of fourth protrusions 5 is extruded from the partition 11 toward the side wall 12 and another pair of fourth protrusions 5 is extruded from the side wall 12 toward the partition 11. Each of the fourth protrusions 5 has an inclined surface to abut against a facet of the hexagonal rear end of the tool bit 21 which is positioned by the position space 4. One pair of fourth protrusions 5 extruded from the partition 11 is symmetrical to another pair of fourth protrusions 5 extruded from the side wall 12 so that the two pairs of fourth protrusions 5 respectively abut against the two opposite sides of the rear end of the tool bit 21. The first protrusion 3 and the fourth protrusions 5 of the position space 4 are arranged for positioning the tool bit 21 firmly so that the tool bit 21 would not drop down from the position space 4. The protrusions 3 could be arranged as that some of the first protrusions 3 are extruded from one side of the partition 11 toward one direction and the other first protrusions 3 are extruded from another side of the partition 11 toward another direction (as shown in this embodiment); or be arranged as that all of the first protrusions 3 are extruded from the lateral wall 12 toward the same direction.

Figure 4:
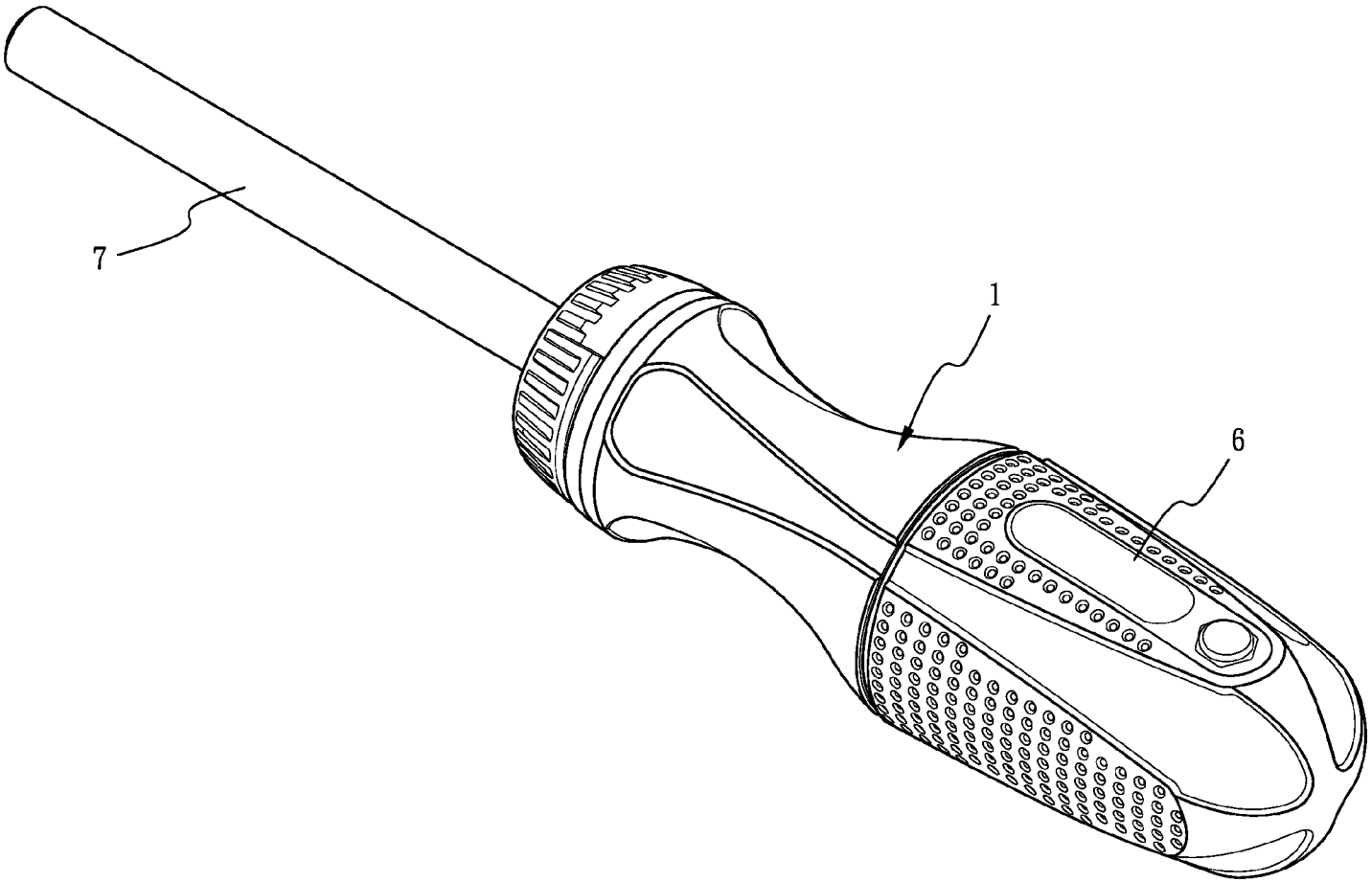
FIG. 4 is an assembled view of the receiving device for tool bits.

Referring to FIG. 4, a cover 6 is connected to the receiving body 1. The receiving body 1 is covered by the cover 6. The support piece 41 supports the bottom of the tool bit 21 so that the support piece 41 prevents the tool bit 21 from moving down relative to the position space 4. Therefore, when a user connects the cover 6 to the receiving body 1, the tool bits 21 which are positioned in the storage room 2 never abut against the cover 6 so that the user can connect the cover 6 to the receiving body 1 without intervening. The tool bit 21 which the user wants could be connected to the head of the driving shaft 7.

Figure 5:
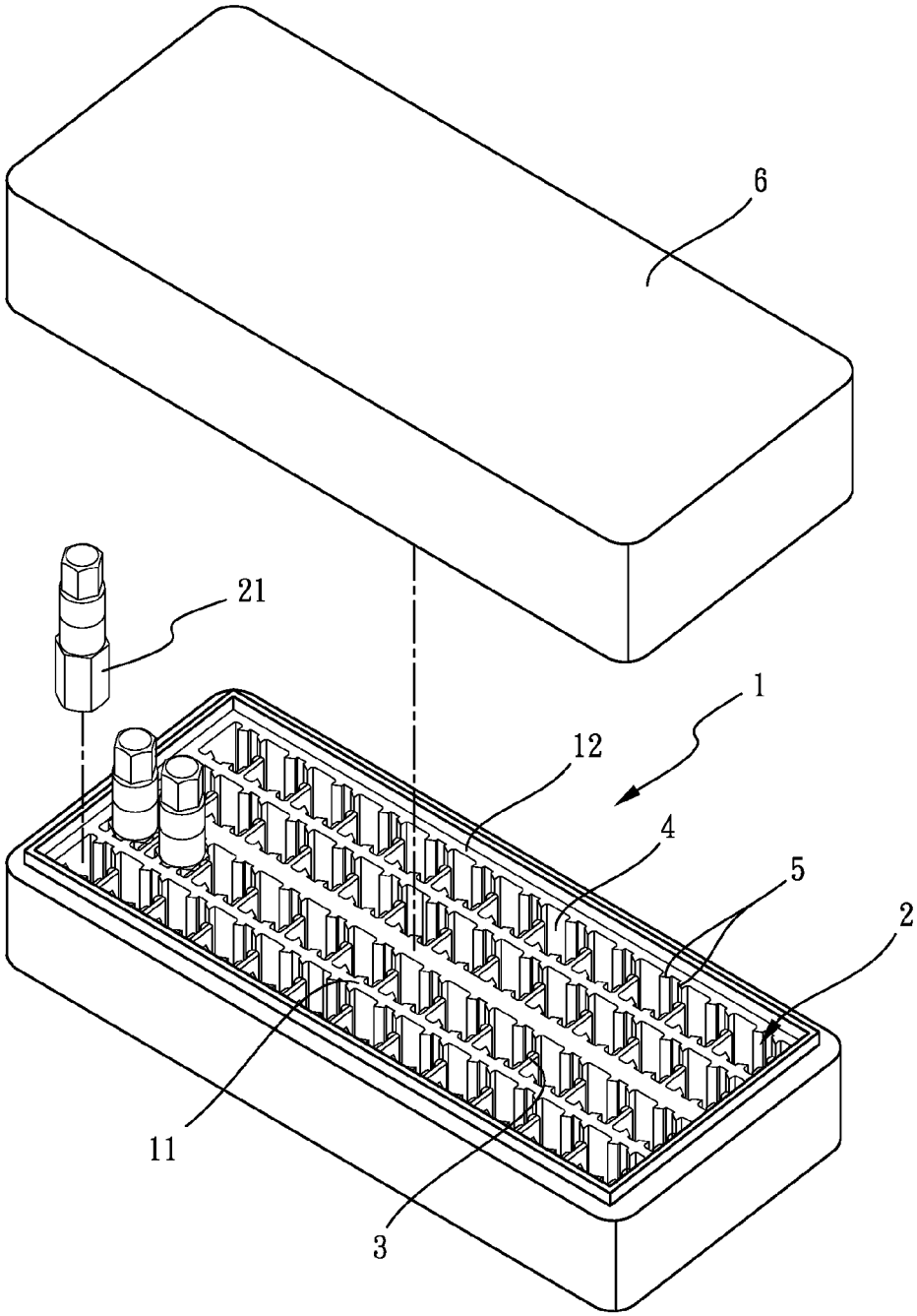
FIG. 5 is the second embodiment of the present invention.

Referring to FIG. 5, the second embodiment is shown as following. The receiving body 1 performs as a box with a detachable cover 6 (as shown in FIG. 5). Four receiving spaces 2 are longwise defined in the receiving body 1 and are located between two lateral walls 12. The four receiving spaces 2 are respectively separated by three partitions 11 which are respectively located in the middle of each pair of the receiving spaces 2. The first protrusions 3 of one receiving space 2 are extruded from one lateral wall 12 and the partitions 11 toward one direction.

Figure 6:
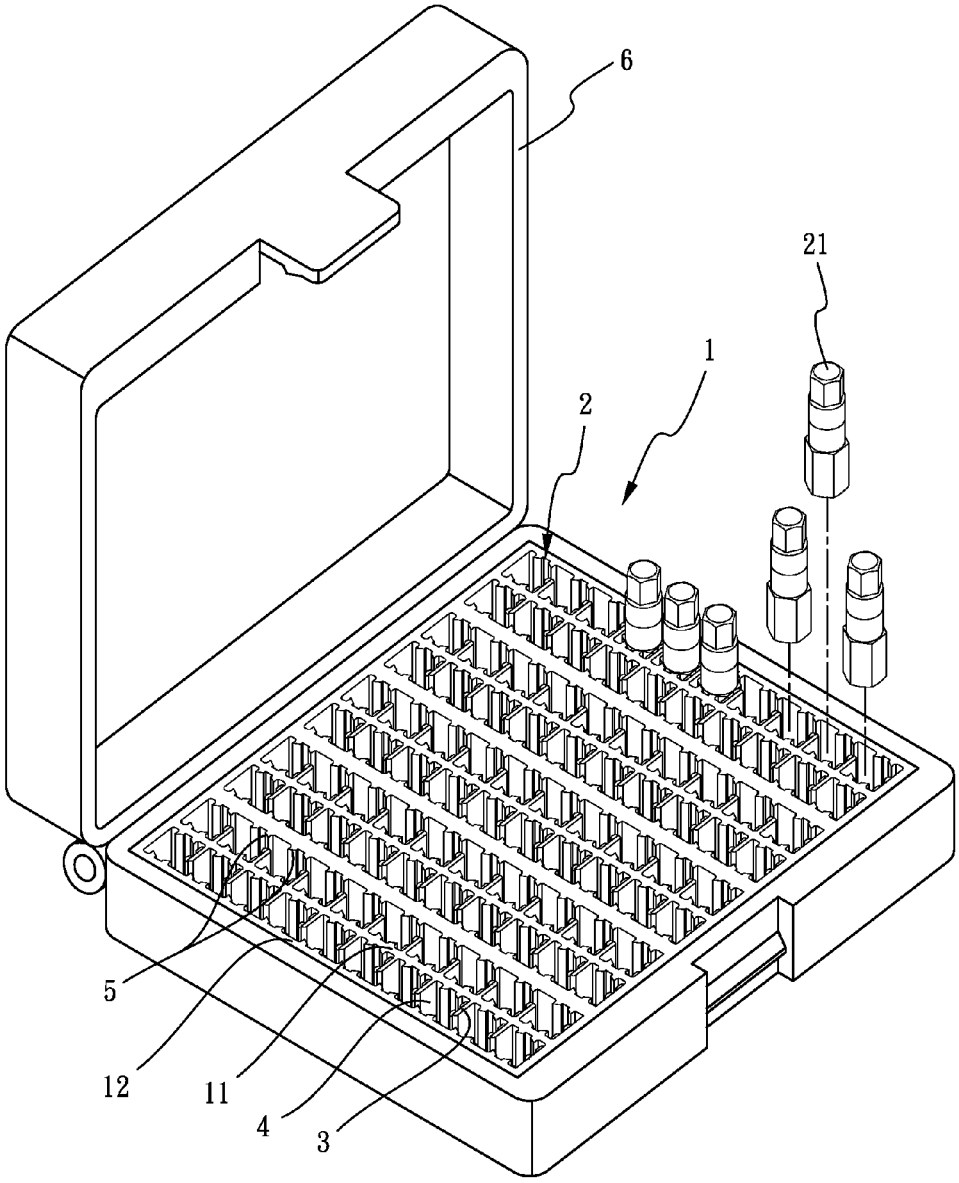
FIG. 6 is the third embodiment of the present invention.

Referring to FIG. 6, the third embodiment is shown as following. The receiving body 1 performs as a box with a cover 6 which is pivoted on the box. Ten receiving spaces 2 are longwise defined in the receiving body 1 and are limited between two lateral walls 12. The ten receiving spaces 2 are respectively separated by nine partitions 11 which are respectively located in the middle of each pair of the receiving spaces 2. The first protrusions 3 are extruded from one side of each partition 11 toward one direction and are extruded from another side of each partition 11 toward another direction.

Figure 7:
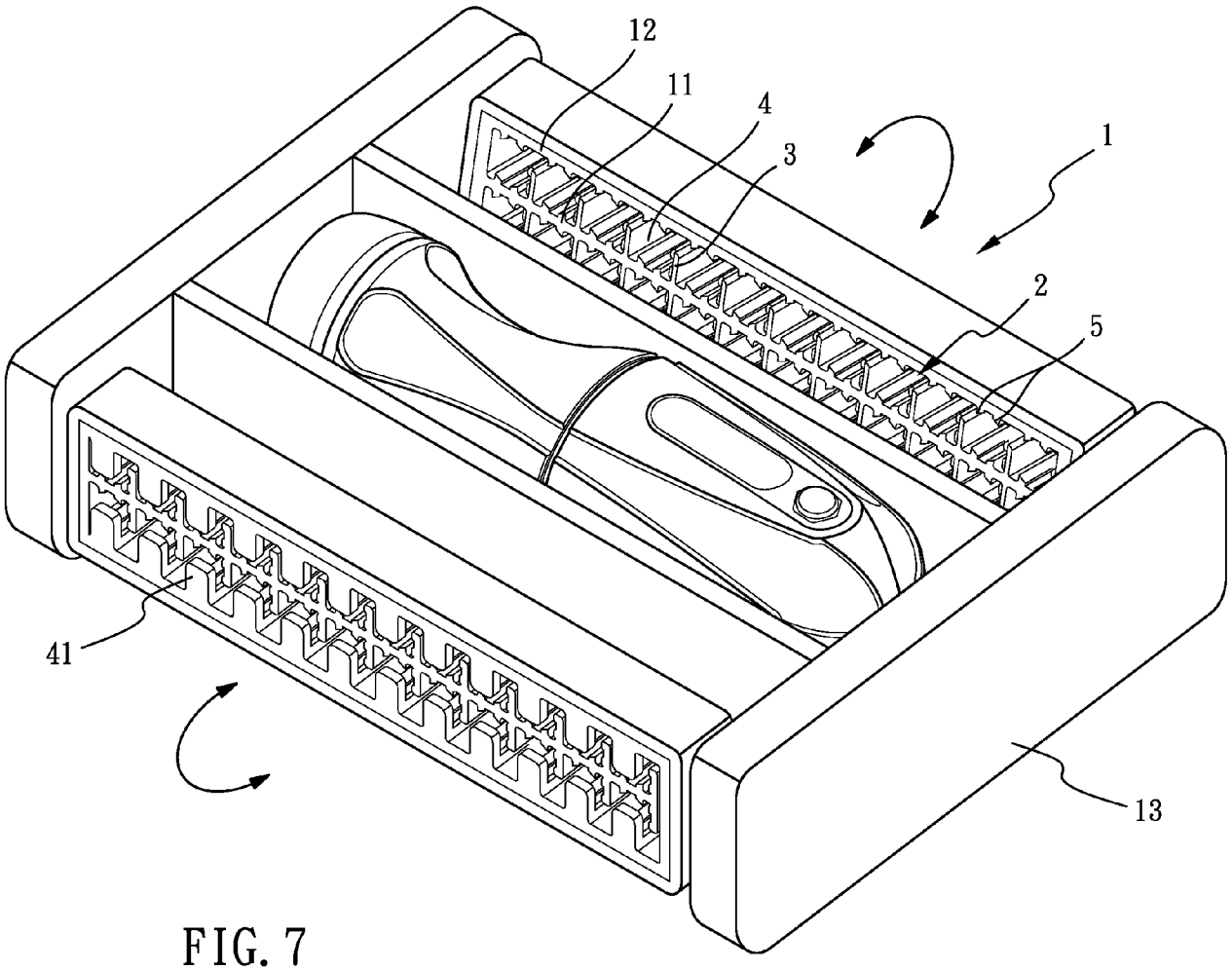
FIG. 7 is the fourth embodiment of the present invention.

Referring to FIG. 7, the fourth embodiment is shown as following. Two receiving bodies 1 are respectively pivoted on two sides of a carrier 13. Two receiving spaces 2 are longwise defined in each receiving body 1 and are limited between two lateral walls 12. The two receiving spaces 2 are separated by the partition 11 which is located in the middle of the two receiving spaces 2. The first protrusions 3 of the receiving space 2 are extruded from one side of the partition 11 toward one direction and the first protrusions 3 of another adjacent receiving space 2 are extruded from another side of the partition 11 toward another direction. The support piece 41 of the position space 4 supports the bottom of the tool bit 21 so that the support piece 41 prevents the tool bit 21 from moving down relative to the position space 4. Therefore, when the receiving body 1 is rotated until the position space 4 faces the inner of the carrier 13, the tool bit 21 positioned by the position space 4 never drops out from the receiving body 1.

Although the invention has been explained in relation to its preferred embodiment, it is to be understood that many other possible modifications and variations can be made without departing from the spirit and scope of the invention as hereinafter claimed.

What is claimed is:

1. A screwdriver, comprising:

a shaft;

at least one tool bit with a drive end and a rear end, the rear end being of hexagonal cross section to be inserted into one end of the shaft; and a handle connected to the other end of the shaft, and including a cuddy portion having two parallel side walls, a storage room defined between the side walls, a longitudinal partition parallel to the side walls, at least two elastic partitioning arms transversely extending from opposite sides of the longitudinal partition, and at least four retaining ribs; the longitudinal partition and the transverse arms together dividing the storage room into a plurality of compartments between the side walls; the four retaining ribs being disposed in each of the compartments; and two of the retaining ribs being formed on an inner wall surface of the respective side wall and the other two being on a respective side surface of the longitudinal partition;

wherein each of the four retaining ribs has an inclined surface for abutting against a respective facet of the hexagonal rear end of the tool bit, and each of the elastic partitioning arms is formed with a knob on a side thereof to bear against another facet of the rear end of the tool bit such that when the tool bit is inserted in the respective compartment, the hexagonal rear end of the tool bit is fitted in among the four retaining ribs and is securely retained in position by the partitioning arm.

2. The screwdriver of claim 1, wherein the cuddy portion further includes a row of support pieces each transversely extending from a bottom of each of the side walls toward a respective one of the compartments to sustain the tool bit.

3. The screwdriver of claim 1, wherein the handle further includes a cover provided to detachably enclose the cuddy portion.

* * * * *